US006709572B2

(12) United States Patent
Corma

(10) Patent No.: US 6,709,572 B2
(45) Date of Patent: Mar. 23, 2004

(54) CATALYTIC CRACKING PROCESS

(75) Inventor: Avelino Corma, Valencia (ES)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/367,294

(22) Filed: Feb. 14, 2003

(65) Prior Publication Data

US 2003/0171634 A1 Sep. 11, 2003

Related U.S. Application Data

(60) Provisional application No. 60/362,100, filed on Mar. 5, 2002.

(51) Int. Cl.[7] ..... C10G 11/05

(52) U.S. Cl. ..... 208/113; 208/120.01; 585/651; 585/653

(58) Field of Search ..... 208/113, 120.01; 585/651, 653

(56) References Cited

U.S. PATENT DOCUMENTS 4,828,679 A * 5/1989 Cormier et al. ..... 208/120.05
6,471,941 B1 * 10/2002 Boix et al. ..... 423/707

OTHER PUBLICATIONS

Hobson, G.D., "Modern Petroleum Technology", 1973, John Wiley & Sons, pp. 201–203.*

* cited by examiner

*Primary Examiner*—Walter D. Griffin
(74) *Attorney, Agent, or Firm*—Ronald D. Hantman

(57) ABSTRACT

A catalytic cracking process for selectively producing $C_2$ to $C_4$ olefins is described in which a feedstock containing hydrocarbons having at least 5 carbon atoms is contacted, under catalytic cracking conditions, with a catalyst composition comprising the synthetic porous crystalline material ITQ-13 and, optionally, a large pore molecular sieve, such as zeolite Y.

20 Claims, 2 Drawing Sheets

CATALYTIC CRACKING PROCESS

This application is a Non-Provisional of Provisional U.S. Serial No. 60/362,100 filed Mar. 5, 2002.

BACKGROUND TO THE INVENTION

This invention relates to a process for catalytic cracking of hydrocarbon feedstocks to produce an enhanced yield of light ($C_2$–$C_4$) olefins and in particular an enhanced yield of propylene.

DESCRIPTION OF THE PRIOR ART

Catalytic cracking, and particularly fluid catalytic cracking (FCC), is routinely used to convert heavy hydrocarbon feedstocks to lighter products, such as gasoline and distillate range fractions. Conventional processes for catalytic cracking of heavy hydrocarbon feedstocks to gasoline and distillate fractions typically use a large pore molecular sieve, such as zeolite Y, as the primary cracking component. It is also well-known to add a medium pore molecular sieve, such as ZSM-5 and ZSM-35, to the cracking catalyst composition to increase the octane number of the gasoline fraction (see U.S. Pat. No. 4,828,679).

In addition, it is known from, for example, U.S. Pat. No. 4,969,987 to employ medium pore molecular sieves, such as ZSM-5 and ZSM-12, to crack paraffinic and naphthenic naphthas to produce a light olefinic fraction rich in $C_4$–$C_5$ isoalkenes and a $C_6$+ liquid fraction of enhanced octane value.

There is, however, an increasing need to enhance the yield of light olefins, especially propylene, in the product slate from catalytic cracking processes. Thus propylene is in high demand for a variety commercial application, particularly in the manufacture of polypropylene, isopropyl alcohol, propylene oxide, cumene, synthetic glycerol, isoprene, and oxo alcohols.

Co-pending U.S. patent application Ser. No. 09/866,907 describes a synthetic porous crystalline material, ITQ-13, which is a single crystalline phase material having a unique 3-dimensional channel system comprising three sets of channels, two defined by 10-membered rings of tetrahedrally coordinated atoms and the third by 9-membered rings of tetrahedrally coordinated atoms.

According to the present invention, it has now been found that the porous crystalline material, ITQ-13, is effective in producing enhanced yields of propylene, as compared with known intermediate pore molecular sieves, such as ZSM-5, when used to crack naphthas and when used as a additive catalyst in combination with a large pore molecular sieve catalyst in the catalytic cracking of heavier hydrocarbon feedstocks, such as vacuum gas oils.

SUMMARY OF THE INVENTION

Thus, in its broadest aspect, the present invention resides in a catalytic cracking process for selectively producing $C_2$ to $C_4$ olefins, the process comprising contacting, under catalytic cracking conditions, a feedstock containing hydrocarbons having at least 5 carbon atoms with a catalyst composition comprising a synthetic porous crystalline material comprising a framework of tetrahedral atoms bridged by oxygen atoms, the tetrahedral atom framework being defined by a unit cell with atomic coordinates in nanometers shown in Table 1 below, wherein each coordinate position may vary within ±0.05 nanometer.

Preferably, the synthetic porous crystalline material has an X-ray diffraction pattern including d-spacing and relative intensity values substantially as set forth in Table 2 below.

In one preferred embodiment of the invention, the feedstock comprises a naphtha having a boiling range of about 25° C. to about 225° C.

In a further preferred embodiment of the invention, the feedstock comprises hydrocarbon mixture having an initial boiling point of at least 200° C. and the catalyst composition also comprises a large pore molecular sieve having a pore size greater than 6 Angstrom.

DETAILED DESCRIPTION OF THE PREFERRED EMBODIMENTS

Figure 1:
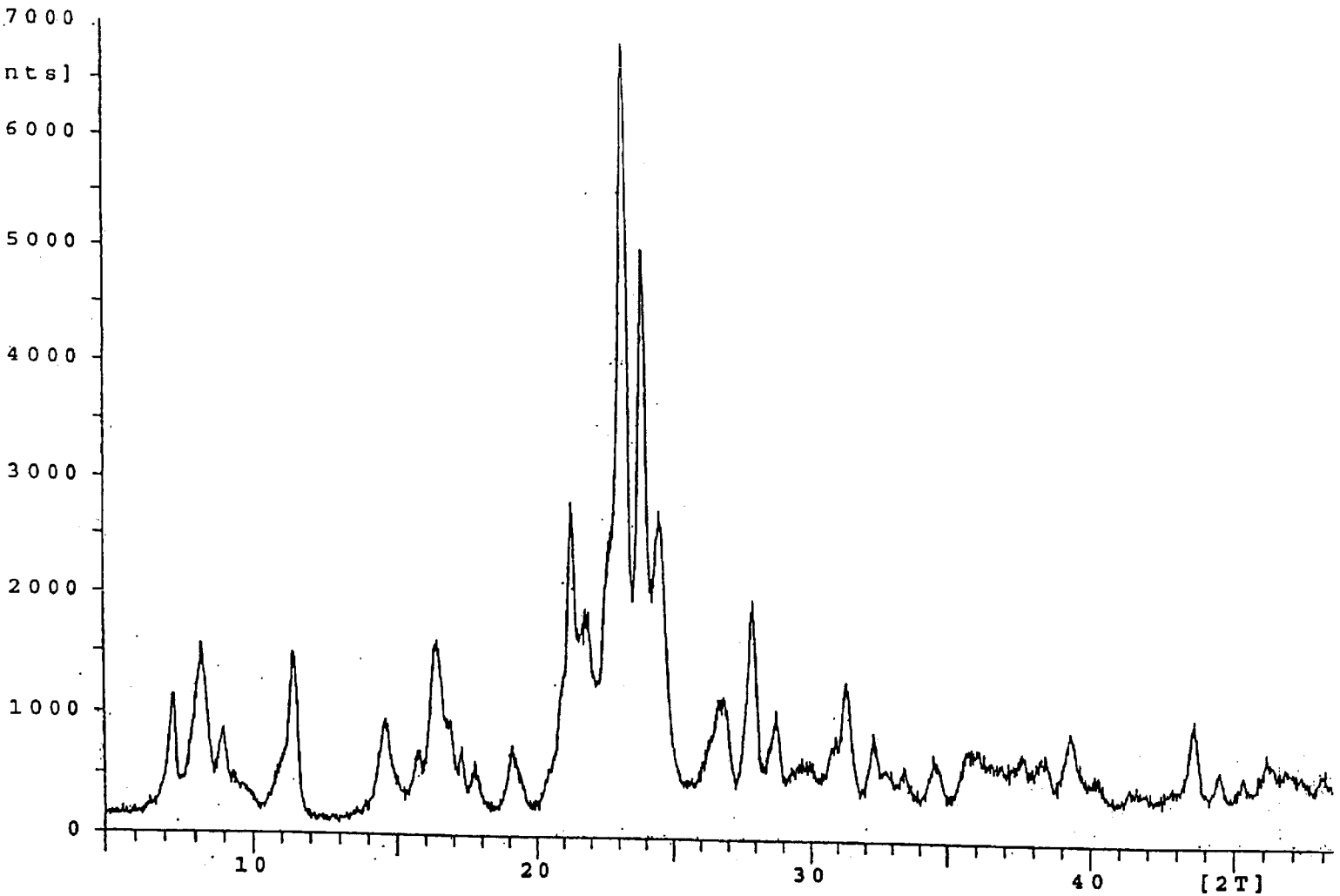
FIGS. 1 and 2 are X-ray diffraction patterns of the boron-containing and the aluminum-containing ITQ-13 products respectively of Example 1.

The present invention provides a process for converting feedstock hydrocarbon compounds to product hydrocarbon compounds of lower molecular weight than the feedstock hydrocarbon compounds. In particular, the present invention provides a process for catalytically cracking a hydrocarbon feedstock having at least 5 carbon atoms to selectively produce $C_2$ to $C_4$ olefins, and in particular to selectively produce propylene. The process of the invention employs a catalyst composition comprising the synthetic porous crystalline material ITQ-13 and, optionally, a large pore molecular sieve having a pore size greater than 6 Angstrom.

ITQ-13 Catalyst Component

The synthetic porous crystalline material ITQ-13 is described in our co-pending U.S. patent application Ser. No. 09/866,907 and is a single crystalline phase that has a unique 3-dimensional channel system comprising three sets of channels. In particular, ITQ-13 comprises a first set of generally parallel channels each of which is defined by a 10-membered ring of tetrahedrally coordinated atoms, a second set of generally parallel channels which are also defined by 10-membered rings of tetrahedrally coordinated atoms and which are perpendicular to and intersect with the channels of the first set, and a third set of generally parallel channels which intersect with the channels of said first and second sets and each of which is defined by a 9-membered ring of tetrahedrally coordinated atoms. The first set of 10-ring channels each has cross-sectional dimensions of about 4.8 Angstrom by about 5.5 Angstrom, whereas the second set of 10-ring channels each has cross-sectional dimensions of about 5.0 Angstrom by about 5.7 Angstrom. The third set of 9-ring channels each has cross-sectional dimensions of about 4.0 Angstrom by about 4.9 Angstrom.

The structure of ITQ-13 may be defined by its unit cell, which is the smallest structural unit containing all the structural elements of the material. Table 1 lists the positions of each tetrahedral atom in the unit cell in nanometers; each tetrahedral atom is bonded to an oxygen atom that is also bonded to an adjacent tetrahedral atom. Since the tetrahedral atoms may move about due to other crystal forces (presence of inorganic or organic species, for example), a range of ±0.05 nm is implied for each coordinate position.

TABLE 1

| | | | |
|---|---|---|---|
| T1 | 0.626 | 0.159 | 0.794 |
| T2 | 0.151 | 0.151 | 0.478 |
| T3 | 0.385 | 0.287 | 0.333 |
| T4 | 0.626 | 0.158 | 0.487 |
| T5 | 0.153 | 0.149 | 0.781 |
| T6 | 0.383 | 0.250 | 1.993 |
| T7 | 0.473 | 0.153 | 0.071 |
| T8 | 0.469 | 0.000 | 1.509 |
| T9 | 0.466 | 0.000 | 1.820 |

TABLE 1-continued

| | | | |
|---|---|---|---|
| T10 | 0.626 | 0.979 | 0.794 |
| T11 | 1.100 | 0.987 | 0.478 |
| T12 | 0.867 | 0.851 | 0.333 |
| T13 | 0.626 | 0.980 | 0.487 |
| T14 | 1.099 | 0.989 | 0.781 |
| T15 | 0.869 | 0.888 | 1.993 |
| T16 | 0.778 | 0.985 | 0.071 |
| T17 | 0.783 | 0.000 | 1.509 |
| T18 | 0.785 | 0.000 | 1.820 |
| T19 | 0.151 | 0.987 | 0.478 |
| T20 | 0.385 | 0.851 | 0.333 |
| T21 | 0.153 | 0.989 | 0.781 |
| T22 | 0.383 | 0.888 | 1.993 |
| T23 | 0.473 | 0.985 | 0.071 |
| T24 | 1.100 | 0.151 | 0.478 |
| T25 | 0.867 | 0.287 | 0.333 |
| T26 | 1.099 | 0.149 | 0.781 |
| T27 | 0.869 | 0.250 | 1.993 |
| T28 | 0.778 | 0.153 | 0.071 |
| T29 | 0.626 | 0.728 | 1.895 |
| T30 | 0.151 | 0.720 | 1.579 |
| T31 | 0.385 | 0.856 | 1.433 |
| T32 | 0.626 | 0.727 | 1.588 |
| T33 | 0.153 | 0.718 | 1.882 |
| T34 | 0.383 | 0.819 | 0.893 |
| T35 | 0.473 | 0.722 | 1.171 |
| T36 | 0.469 | 0.569 | 0.409 |
| T37 | 0.466 | 0.569 | 0.719 |
| T38 | 0.626 | 0.410 | 1.895 |
| T39 | 1.100 | 0.418 | 1.579 |
| T40 | 0.867 | 0.282 | 1.433 |
| T41 | 0.626 | 0.411 | 1.588 |
| T42 | 1.099 | 0.420 | 1.882 |
| T43 | 0.869 | 0.319 | 0.893 |
| T44 | 0.778 | 0.416 | 1.171 |
| T45 | 0.783 | 0.569 | 0.409 |
| T46 | 0.785 | 0.569 | 0.719 |
| T47 | 0.151 | 0.418 | 1.579 |
| T48 | 0.385 | 0.282 | 1.433 |
| T49 | 0.153 | 0.420 | 1.882 |
| T50 | 0.383 | 0.319 | 0.893 |
| T51 | 0.473 | 0.416 | 1.171 |
| T52 | 1.100 | 0.720 | 1.579 |
| T53 | 0.867 | 0.856 | 1.433 |
| T54 | 1.099 | 0.718 | 1.882 |
| T55 | 0.869 | 0.819 | 0.893 |
| T56 | 0.778 | 0.722 | 1.171 |

ITQ-13 can be prepared in essentially pure form with little or no detectable impurity crystal phases and has an X-ray diffraction pattern which is distinguished from the patterns of other known as-synthesized or thermally treated crystalline materials by the lines listed in Table 2 below.

TABLE 2

| d(Å) | Relative Intensities (I) |
|---|---|
| 12.46 ± 0.2 | w–vs |
| 10.97 ± 0.2 | rn–vs |
| 10.12 ± 0.2 | vw–w |
| 8.25 ± 0.2 | vw |
| 7.87 ± 0.2 | w–vs |
| 5.50 ± 0.15 | w–m |
| 5.45 ± 0.15 | vw |
| 5.32 ± 0.15 | vw–w |
| 4.70 ± 0.15 | vw |
| 4.22 ± 0.15 | w–m |
| 4.18 ± 0.15 | vw–w |
| 4.14 ± 0.15 | w |
| 3.97 ± 0.1 | w |
| 3.90 ± 0.1 | vw–m |
| 3.86 ± 0.1 | m–vs |
| 3.73 ± 0.1 | m–vs |
| 3.66 ± 0.1 | m–s |

These X-ray diffraction data were collected with a Scintag diffraction system, equipped with a germanium solid state detector, using copper K-alpha radiation. The diffraction data were recorded by step-scanning at 0.02 degrees of two-theta, where theta is the Bragg angle, and a counting time of 10 seconds for each step. The interplanar spacings, d's, were calculated in Angstrom units, and the relative intensities of the lines, $I/I_o$ is one-hundredth of the intensity of the strongest line, above background, were derived with the use of a profile fitting routine (or second derivative algorithm). The intensities are uncorrected for Lorentz and polarization effects. The relative intensities are given in terms of the symbols vs=very strong (80–100), s=strong (60–80), m=medium (40–60), w=weak (20–40), and vw=very weak (0–20). It should be understood that diffraction data listed for this sample as single lines may consist of multiple overlapping lines which under certain conditions, such as differences in crystallographic changes, may appear as resolved or partially resolved lines. Typically, crystallographic changes can include minor changes in unit cell parameters and/or a change in crystal symmetry, without a change in the structure. These minor effects, including changes in relative intensities, can also occur as a result of differences in cation content, framework composition, nature and degree of pore filling, crystal size and shape, preferred orientation and thermal and/or hydrothermal history.

ITQ-13 has a composition involving the molar relationship:

$$X_2O_3:(n)YO_2,$$

wherein X is a trivalent element, such as aluminum, boron, iron, indium, and/or gallium, preferably boron; Y is a tetravalent element such as silicon, tin, titanium and/or germanium, preferably silicon; and n is at least about 5, such as about 5 to ∞, and usually from about 40 to about ∞. It will be appreciated from the permitted values for n that ITQ-13 can be synthesized in totally siliceous form in which the trivalent element X is absent or essentially absent.

Processes for synthesizing ITQ-13 employ fluorides, in particular HF, as a mineralizing agent and hence, in its as-synthesized form, ITQ-13 has a formula, on an anhydrous basis and in terms of moles of oxides per n moles of $YO_2$, as follows:

$$(0.2–0.4)R:X_2O_3:(n)YO_2:(0.4–0.8)F$$

wherein R is an organic moiety. The R and F components, which are associated with the material as a result of their presence during crystallization, are easily removed by post-crystallization methods hereinafter more particularly described.

To the extent desired and depending on the $X_2O_3/YO_2$ molar ratio of the material, any cations in the as-synthesized ITQ-13 can be replaced in accordance with techniques well known in the art, at least in part, by ion exchange with other cations. Preferred replacing cations include metal ions, hydrogen ions, hydrogen precursor, e.g., ammonium ions and mixtures thereof. Particularly preferred cations are those which tailor the catalytic activity for certain hydrocarbon conversion reactions. These include hydrogen, rare earth metals and metals of Groups IIA, IIIA, IVA, VA, IB, IIB, IIIB, IVB, VB, VIB, VIIB and VIII of the Periodic Table of the Elements.

The as-synthesized ITQ-13 may be subjected to treatment to remove part or all of any organic constituent used in its synthesis. This is conveniently effected by thermal treatment in which the as-synthesized material is heated at a temperature of at least about 370° C. for at least 1 minute and generally not longer than 20 hours. While subatmospheric pressure can be employed for the thermal treatment, atmospheric pressure is desired for reasons of convenience. The thermal treatment can be performed at a temperature up to about 925° C. The thermally treated product, especially in its metal, hydrogen and ammonium forms, is particularly useful in the catalysis of certain organic, e.g., hydrocarbon, conversion reactions.

Prior to use in the process of the invention, the ITQ-13 is preferably dehydrated, at least partially. This can be done by heating to a temperature in the range of 200° C. to about 370° C. in an atmosphere such as air, nitrogen, etc., and at atmospheric, subatmospheric or superatmospheric pressures for between 30 minutes and 48 hours. Dehydration can also be performed at room temperature merely by placing the ITQ-13 in a vacuum, but a longer time is required to obtain a sufficient amount of dehydration.

The silicate and borosilicate forms of ITQ-13 can be prepared from a reaction mixture containing sources of water, optionally an oxide of boron, an oxide of tetravalent element Y, e.g., silicon, a directing agent (R) as described below and fluoride ions, said reaction mixture having a composition, in terms of mole ratios of oxides, within the following ranges:

| Reactants | Useful | Preferred |
|---|---|---|
| $YO_2/B_2O_3$ | at least 5 | At least 40 |
| $H_2O/YO_2$ | 2–50 | 5–20 |
| $OH^-/YO_2$ | 0.05–0.7 | 0.2–0.4 |
| $F/YO_2$ | 0.1–1 | 0.4–0.8 |
| $R/YO_2$ | 0.05–0.7 | 0.2–0.4 |

The organic directing agent R used herein is the hexamethonium [hexamethylenebis(trimethylammonium)] dication and preferably is hexamethonium dihydroxide. Hexamethonium dihydroxide can readily be prepared by anion exchange of commercially available hexamethonium bromide.

Crystallization of ITQ-13 can be carried out at either static or stirred conditions in a suitable reactor vessel, such as for example, polypropylene jars or Teflon®-lined or stainless steel autoclaves, at a temperature of about 120° C. to about 160° C. for a time sufficient for crystallization to occur at the temperature used, e.g., from about 12 hours to about 30 days. Thereafter, the crystals are separated from the liquid and recovered.

It should be realized that the reaction mixture components can be supplied by more than one source. The reaction mixture can be prepared either batch-wise or continuously. Crystal size and crystallization time of the new crystalline material will vary with the nature of the reaction mixture employed and the crystallization conditions.

Synthesis of ITQ-13 may be facilitated by the presence of at least 0.01 percent, preferably 0.10 percent and still more preferably 1 percent, seed crystals (based on total weight) of crystalline product.

The ITQ-13 used in the process of the invention is preferably an aluminosilicate or boroaluminosilicate and more preferably has a silica to alumina molar ratio of less than about 1000. Aluminosilicate ITQ-13 can readily be produced from the silicate and borosilicate forms by post-synthesis methods well-known in the art, for example by ion exchange of the borosilicate material with a source of aluminum ions.

Optional Large Pore Cracking Component

Particularly when employed to crack heavy hydrocarbons feedstocks, such as those having an initial boiling point of about 200° C., the catalyst composition used in the process of the invention comprises a large pore molecular sieve having a pore size greater than 6 Angstrom, and preferably greater than 7 Angstrom, in addition to ITQ-13. Typically, where the catalyst contains a large pore molecular sieve, the weight ratio of the ITQ-13 to the large pore molecular sieve is about 0.005 to 50, preferably about 0.1 to 1.0.

The large-pore cracking component may be any conventional molecular sieve having cracking activity and a pore size greater than 6 Angstrom including zeolite X (U.S. Pat. No. 2,882,442); REX; zeolite Y (U.S. Pat. No. 3,130,007); Ultrastable Y zeolite (USY) (U.S. Pat. No. 3,449,070); Rare Earth exchanged Y (REY) (U.S. Pat. No. 4,415,438); Rare Earth exchanged USY (REUSY); Dealuminated Y (DeAl Y) (U.S. Pat. No. 3,442,792; U.S. Pat. No. 4,331,694); Ultrahydrophobic Y (UHPY) (U.S. Pat. No. 4,401,556); and/or dealuminated silicon-enriched zeolites, e.g., LZ-210 (U.S. Pat. No. 4,678,765). Zeolite ZK-5 (U.S. Pat. No. 3,247,195); zeolite ZK-4 (U.S. Pat. No. 3,314,752); ZSM-20 (U.S. Pat. No. 3,972,983); zeolite Beta (U.S. Pat. No. 3,308,069) and zeolite L (U.S. Pat. Nos. 3,216,789 and 4,701,315), as well as naturally occurring zeolites such as faujasite, mordenite and the like may also be used. These materials may be subjected to conventional treatments, such as impregnation or ion exchange with rare earths to increase stability. The preferred large pore molecular sieve of those listed above is a zeolite Y, more preferably an REY, USY or REUSY.

Other suitable large-pore crystalline molecular sieves include pillared silicates and/or clays; aluminophosphates, e.g., ALPO4–5, ALPO4–8, VPI-5; silicoaluminophosphates, e.g., SAPO-5, SAPO-37, SAPO-31, SAPO-40; and other metal aluminophosphates. These are variously described in U.S. Pat. Nos. 4,310,440; 4,440,871; 4,554,143; 4,567,029; 4,666,875; 4,742,033; 4,880,611; 4,859,314; and 4,791,083.

Catalyst Matrix

The cracking catalyst will also normally contain one or more matrix or binder materials that are resistant to the temperatures and other conditions e.g., mechanical attrition, which occur during cracking. Where the cracking catalyst contains a large pore molecular sieve in addition to ITQ-13, the matrix material may be used to combine both molecular sieves in each catalyst particle. Alternatively, the same or different matrix materials can be used to produce separate particles containing the large pore molecular sieve and the ITQ-13 respectively. In the latter case, the different catalyst components can be arranged in separate catalyst beds.

The matrix may fulfill both physical and catalytic functions. Matrix materials include active or inactive inorganic materials such as clays, and/or metal oxides such as alumina or silica, titania, zirconia, or magnesia. The metal oxide may be in the form of a sol or a gelatinous precipitate or gel.

Naturally occurring clays that can be employed in the catalyst include the montmorillonite and kaolin families which include the subbentonites, and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, catalyst can include a porous matrix material such as silica-alumina, silica-magnesia, silica-zirconia, silica-thoria, silica-beryllia, silica-titania, as well as ternary materials such as silica-alumina-thoria, silica-alumina-zirconia, silica-alumina-magnesia, silica-magnesia-zirconia. The matrix can be in the form of a cogel. A mixture of these components can also be used.

In general, the relative proportions of molecular sieve component(s) and inorganic oxide matrix vary widely, with the molecular sieve content ranging from about 1 to about 90 percent by weight, and more usually from about 2 to about 80 weight percent of the composite.

Feedstock

The feedstock employed in the process of the invention comprises one or more hydrocarbons having at least 5 carbon atoms.

In one preferred embodiment, the feedstock comprises a naphtha having a boiling range of about 25° C. to about225° C. and preferably a boiling range of 25° C. to 125° C. The naphtha can be a thermally cracked or a catalytically cracked naphtha. Such streams can be derived from any appropriate source, for example, they can be derived from the fluid catalytic cracking (FCC) of gas oils and resids, or they can be derived from delayed or fluid coking of resids. It is preferred that the naphtha streams be derived from the fluid catalytic cracking of gas oils and resids. Such naphthas are typically rich in olefins and/or diolefins and relatively lean in paraffins.

In a further preferred embodiment of the invention, the feedstock comprises a hydrocarbon mixture having an initial boiling point of about 200° C. The hydrocarbon feedstock to be cracked may include, in whole or in part, a gas oil (e.g., light, medium, or heavy gas oil) having an initial boiling point above 200° C., a 50% point of at least 260° C. and an end point of at least 315° C. The feedstock may also include vacuum gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking. The boiling temperatures utilized herein are expressed for convenience in terms of the boiling point corrected to atmospheric pressure. Resids or deeper cut gas oils with high metals contents can also be cracked using the process of the invention.

Catalytic Cracking Process

The catalytic cracking process of the invention can operate at temperatures from about 200° C. to about 870° C. under reduced, atmospheric or superatmospheric pressure. The catalytic process can be either fixed bed, moving bed or fluidized bed and the hydrocarbon flow may be either concurrent or countercurrent to the catalyst flow. The process of the invention is particularly applicable to the Fluid Catalytic Cracking (FCC) or moving bed processes such as the Thermofor Catalytic Cracking (TCC) processes.

The TCC process is a moving bed process wherein the catalyst is in the shape of pellets or beads having an average particle size of about one sixty-fourth to one-fourth inch. Active, hot catalyst beads progress downwardly cocurrent with a hydrocarbon charge stock through a cracking reaction zone. The hydrocarbon products are separated from the coked catalyst and recovered, whereas the coked catalyst is removed from the lower end of the reaction zone and regenerated. Typically TCC conversion conditions include an average reactor temperature of about 450° C. to about 510° C.; catalyst/oil volume ratio of about 2 to about 7; reactor space velocity of about 1 to about 2.5 vol./hr./vol.; and recycle to fresh feed ratio of 0 to about 0.5 (volume).

The process of the invention is particularly applicable to fluid catalytic cracking (FCC), in which the cracking catalyst is typically a fine powder with a particle size of about 10 to 200 microns. This powder is generally suspended in the feed and propelled upward in a reaction zone. A relatively heavy hydrocarbon feedstock, e.g., a gas oil, is admixed with the cracking catalyst to provide a fluidized suspension and cracked in an elongated reactor, or riser, at elevated temperatures to provide a mixture of lighter hydrocarbon products. The gaseous reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbons from the spent catalyst prior to conveying the latter to a catalyst regenerator unit, an inert stripping gas, e.g., steam, is passed through the catalyst bed where it desorbs such hydrocarbons conveying them to the product recovery zone. The fluidizable catalyst is continuously circulated between the riser and the regenerator and serves to transfer heat from the latter to the former thereby supplying the thermal needs of the cracking reaction which is endothermic.

Typically, FCC conversion conditions include a riser top temperature of about 500° C. to about 650° C., preferably from about 500° C. to about 600° C., and most preferably from about 500° C. to about 550° C.; catalyst/oil weight ratio of about 3 to about 12, preferably about 4 to about 11, and most preferably about 5 to about 10; and catalyst residence time of about 0.5 to about 15 seconds, preferably about 1 to about 10 seconds.

The invention will now be more particularly described with reference to the following Examples:

EXAMPLE 1

Borosilicate ITQ-13 was synthesized from a gel having the following molar composition:

$$1SiO_2:0.01B_2O_3:0.29R(OH)_2:0.64\ HF:7H_2O$$

where $R(OH)_2$ is hexamethonium dihydroxide and 4 wt % of the $SiO_2$ was added as ITQ-13 seeds to accelerate the crystallization. The hexamethonium dihydroxide employed in the gel was prepared by direct anionic exchange of commercially available hexamethonium dibromide using a resin, Amberlite IRN-78, as hydroxide source.

The synthesis gel was prepared by hydrolyzing 13.87 g of tetraethyloethosilicate (TEOS) in 62.18 g of a 0.006M hexamethonium dihydroxide solution containing 0.083 g of boric acid. The hydrolysis was effected under continuous mechanical stirring at 200 rpm, until the ethanol and an appropriate amount of water were evaporated to yield the above gel reaction mixture. After the hydrolysis step, a suspension of 0.16 g of as-synthesized ITQ-13 in 3.2 g of water was added as seeds and then a solution of 1.78 g of HF (48 wt % in water) and 1 g of water were slowly added to produce the required reaction mixture. The reaction mixture was mechanically and finally manually stirred until a homogeneous gel was formed. The resulting gel was very thick as. a consequence of the small amount of water present. The gel was autoclaved at 135° C. for 21 days under continuous tumbling at 60 rpm. The pH of the final gel (prior of filtration) was 6.5–7.5. The solid was recovered by filtration, washed with distilled water and dried at 100° C., overnight. The occluded hexamethonium and fluoride ions were removed from the product by heating the product from room temperature to 540° C. at 1° C./min under $N_2$ flow (60 ml/mm). The temperature was kept at 540° C. under $N_2$ for 3 hours and then the flow was switched to air and the temperature kept at 540° C. for a further 3 hours in order to burn off the remaining organic. X-ray analysis (FIG. 1) showed the calcined product to be ITQ-13 containing some ZSM-50 impurity, whereas boron analysis indicated the Si/B atomic ratio of the final solid to be about 60.

Figure 2:
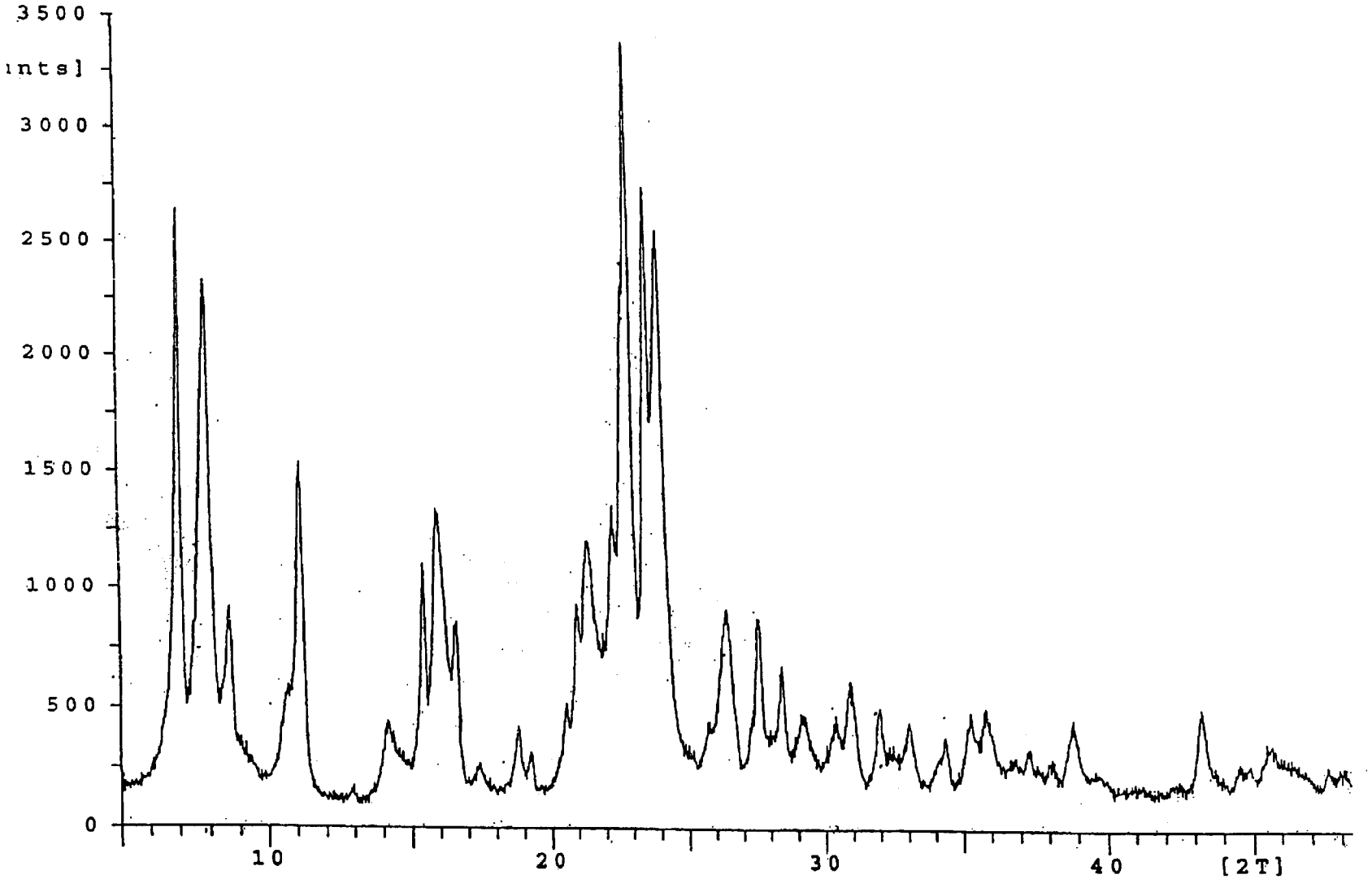

Aluminum-containing ITQ-13 was prepared using ion exchange by suspending, under stirring, 0.74 g of the calcined B-ITQ-13 in 10.5 g of an aqueous $Al(NO_3)_3$ solution containing 8 wt % $Al(NO_3)_3$ and then transferring the resultant suspension to an autoclave, where the suspension was heated at 135° C. for 3 days under continuous stirring at 60 rpm. The resulting solid was filtered, washed with distilled water until the water was at neutral pH and dried at 100° C., overnight. The X-ray diffraction pattern of the resultant product is shown in FIG. 2. Chemical analysis indicated the product to have a Si/Al atomic ratio of 80 and a Si/B atomic ratio greater than 500.

EXAMPLE 2

Five separate catalysts were prepared from (a) the aluminum-containing ITQ-13 from Example 1, (b) ZSM-5, (c) ferrierite (FER) (d) a commercially available USY having a unit cell size of 2.432 nm and (e) a commercially available USY having a unit cell size of 2.426 nm. The properties of the various zeolites employed were as follows:

| Zeolite | ZSM-5 | ITQ-13 | FER | USY 2.432 nm | USY 2.426 nn |
|---|---|---|---|---|---|
| Surface Area, m2/g | 385 | 354 | 280 | 641 | 551 |
| Crystal Size, micron | 0.5–1 | 0.1–0.3 | 1–3 | 0.5 | 0.5 |
| Si/Al atomic area | 43 | 80 | 60 | 19* | 62* |
| Bronsted Activity (μmol Py/g) | | | | | |
| T = 523K | 40 | 18 | 21 | 77 | 14 |
| T = 623K | 26 | 12 | 14 | 45 | 3 |
| T = 673K | 7 | 5 | 5 | 28 | 1 |
| Lewis Activity (μmol Py/g) | | | | | |
| T = 523K | 6 | 8 | 2 | 9 | 10 |
| T = 623K | 5 | 6 | 1 | 8 | 7 |
| T = 673K | 5 | 6 | 1 | 7 | 4 |

*= after steaming

Each of catalysts (a) to (c) contained 0.5 gm of the zeolite diluted with 2.5 gm of inert silica, whereas each of catalysts (d) and (e) contained 1.20 gm of USY diluted with 0.30 gm of inert silica.

EXAMPLE 3

The catalysts containing ITQ-13 and ZSM-5 produced in Example 2 were used to crack hexene-1 and 4-methylpentene-1 in a conventional Microactivity Test Unit (MAT) at 500° C., 60 seconds time on stream, and catalyst to oil ratios (w/w) of 0.3–0.7. Gases were analyzed by gas chromatography in a HP 5890 Chromatograph with a two-column system in series using argon as the carrier gas. Hydrogen, nitrogen and methane were separated in a 15 m long, 0.53 mm (internal diameter, molecular sieve 5A column and thermal conductivity detector. $C_2$ to $C_5$ hydrocarbons were separated in a 50 m long, 0.53 mm internal diameter alumina plot column and flame ionization detector. Liquids were analyzed in a Varian 3400 with a 100 m long, 0.25 mm internal diameter Petrocol DH column.

The results of cracking the two olefins are shown below in Tables 1 and 2. These have been estimated at constant conversion by fitting the individual component analyses over the range of catalyst/oil ratios used in the experiments to suitable polynomials and interpolated at a central point. It will be seen from Tables 1 and 2 that the catalyst containing ITQ-13 provided much higher yields of propylene (20.86 wt % for hexene-1 and 19.7 wt % for 4-methylpentene-1) than the catalyst containing ZSM-5 (11.91 wt % for hexene-1 and 11.21 wt % for 4-methylpentene-1). Moreover the catalyst containing ITQ-13 provided much higher ratios of propylene to propane (35 for hexene-1 and 22 for 4-methylpentene-1) than the catalyst containing ZSM-5 (6 for hexene-1 and 7 for 4-methylpentene-1).

TABLE 1

| CATALYST | ZSM-5 | ITO-13 |
|---|---|---|
| Feed | Hexane-1 | Hexene-1 |
| Cat/Oil | 0.05 | 0.09 |
| Conversion, wt % | 54 | 54 |
| Liquids, wt % | 25.81 | 18.37 |
| Gases, wt % | 27.85 | 34.81 |
| Coke, wt % | 0.35 | 0.53 |
| $H_2$, wt % | 0.01 | 0.003 |
| C1, wt % | 0.04 | 0.06 |
| C2,wt % | 0.13 | 0.14 |
| C2 =, wt % | 2.67 | 2.43 |
| C3,wt % | 1.70 | 0.60 |
| C3 =,wt % | 11.91 | 20.86 |
| iC4, wt % | 1.54 | 0.50 |
| nC4, wt % | 0.73 | 0.20 |
| t2C4 =,wt % | 1.81 | 2.14 |
| lC4 =, wt % | 1.94 | 2.07 |
| iC4 =, wt % | 3.88 | 3.86 |
| c2C4 =, wt % | 1.48 | 1.74 |

TABLE 2

| CATALYST | ZSM-5 | ITQ-13 |
|---|---|---|
| Feed | 4-methylpentene-1 | 4-methylpentene-1 |
| Cat/Oil | 0.05 | 0.09 |
| Conversion, wt % | 9.00 | 49.00 |
| Liquids, wt % | 21.84 | 16.03 |
| Gases, wt % | 26.82 | 32.31 |
| Coke, wt % | 0.34 | 0.67 |
| H2, wt % | 0.01 | 0.009 |
| C1, wt % | 0.05 | 0.10 |
| C2, wt % | 0.07 | 0.06 |
| C2, =, wt % | 2.33 | 2.02 |
| C3, wt % | 1.65 | 0.88 |
| C3 =,wt % | 11.21 | 19.17 |
| IC4, wt % | 1.47 | 0.60 |
| nC4, wt % | 0.72 | 0.18 |
| t2C4 =, wt % | 1.84 | 2.03 |
| lC4 =, wt % | 1.95 | 1.94 |
| iC4 =, wt % | 3.95 | 3.76 |
| c2C4 =, wt % | 1.55 | 1.66 |

EXAMPLE 4

The use of the ITQ-13, ZSM-5 and FER catalysts of Example 2 as additives to the USY cracking catalysts of Example 2 in the cracking of a vacuum gas oil were studied in a similar MAT unit to that used in Example 3. The USY and additive catalysts were placed in separate beds. The top bed contained the USY zeolite and the bottom bed contained the zeolite additive diluted in 1.10 gm of silica. The properties of the vacuum gas oil used are given in Table 3.

TABLE 3

| | |
|---|---|
| Density (15° C.) g/cc | 0.917 |
| Aniline Point (° C.) | 79.2 |
| S (Wt %) | 1.65 |
| N, ppm | 1261 |
| Na, ppm | 0.18 |
| Cu, PPM | <0.1 |
| Fe, ppm | 0.3 |
| Ni, ppm | 0.2 |
| V, ppm | 0.4 |
| ASTM D-1 160(° C.) | |
| 5% | 319 |
| 10% | 352 |
| 30% | 414 |
| 50% | 436 |
| 70% | 459 |
| 90% | 512 |

TABLE 4-continued

| CATALYST | USY (2.432) | ZSM-5 (20%) | ITQ-13 (20%) |
|---|---|---|---|
| Gases, wt % | 12.53 | 21.83 | 18.69 |
| Coke, wt % | 1.46 | 1.82 | 1.38 |
| Gas Yields, wt % | | | |
| H2 | 0.07 | 0.03 | −0.03 |
| Cl | 0.41 | 0.19 | 0.53 |
| C2= | 0.80 | 1.59 | 1.18 |
| C3 | 1.19 | 3.19 | 2.14 |
| C3= | 2.32 | 5.17 | 4.45 |
| iC4 | 3.88 | 4.82 | 4.46 |
| nC4 | 0.89 | 1.81 | 1.41 |
| t2C4'2 | 0.67 | 1.00 | 0.80 |
| lC4= | 0.85 | 0.82 | 1.03 |
| iC4= | 0.82 | 2.02 | 1.93 |
| c2C4= | 0.63 | 0.97 | 0.63 |
| Butene/Butane ratio | 0.62 | 0.72 | 0.75 |
| Propylene/Propane ratio | | | |

TABLE 5

| CATALYST | USY (2.426) | ZSM-5 (20%) | ITQ-13 (20%) | FER (20%) |
|---|---|---|---|---|
| Cat/Oil | 1.13 | 0.74 | 1.10 | 1.49 |
| Gasoline, wt % | 39.23 | 34.36 | 37.87 | 38.53 |
| Diesel, wt % | 13.10 | 12.04 | 13.08 | 13.19 |
| Gases, wt % | 15.64 | 22.05 | 17.53 | 16.46 |
| Coke, wt % | 2.03 | 1.55 | 1.52 | 1.32 |
| Gas Yields, wt % | | | | |
| $H_2$ | 0.03 | 0.04 | 0.03 | 0.04 |
| C1 | 0.63 | 0.57 | 0.29 | 0.34 |
| C2 | 0.59 | 0.58 | 0.26 | 0.23 |
| C2= | 1.00 | 1.81 | 0.85 | 1.17 |
| C3 | 1.47 | 2.40 | 1.04 | 1.33 |
| C3= | 3.41 | 5.65 | 5.15 | 3.99 |
| iC4 | 4.61 | 3.88 | 3.66 | 4.34 |
| nC4 | 1.04 | 1.21 | 0.94 | 1.03 |
| t2C4= | 0.92 | 1.02 | 1.09 | 0.97 |
| lC4= | 0.95 | 1.27 | 0.58 | 1.21 |
| iC4= | 1.13 | 2.41 | 2.02 | 1.40 |
| c2C4= | 0.77 | 1.07 | 1.18 | 0.80 |
| Butene/Butane | 0.67 | 1.13 | 1.06 | 0.82 |
| Propylene/Propane | | 2.32 | 2.35 | 4.943.00 |

The results of the tests are shown in Tables 4 to 7 below. FIGS. 4 and 5 summarize the overall product make with the different USY catalysts, both alone and with the various additive catalysts, whereas Tables 6 and 7 summarize the results of analysis of the gasoline fractions obtained in each test. In the Tables, the first data column shows the results with the USY alone, whereas the data in the columns under the additive zeolites show the results when the additives were used. The percent of additive used corresponds to the weight of additive per 100 g USY zeolite. The catalyst/oil ratios are based on USY only. Estimates were made at constant 75 wt % conversion in the manner described above.

TABLE 4

| CATALYST | USY (2.432) | ZSM-5 (20%) | ITQ-13 (20%) |
|---|---|---|---|
| Cat/Oil | 0.69 | 0.48 | 0.50 |
| Gasoline, wt % | 41.95 | 34.57 | 36.82 |
| Diesel, wt % | 14.56 | 11.77 | 12.61 |

TABLE 6

| CATALYST | BASE CATALYST (USY 2.432 nm) | USY 2.432 nm + 20% ZSM-5 | USY 2.432 nm + 20% ITQ-13 |
|---|---|---|---|
| n-Paraffins | 4.2 | 4.6 | 5.1 |
| i-Paraffins | 26.4 | 21.3 | 23.4 |
| Olefins | 9.1 | 6.1 | 7.0 |
| Naphthenes | 12.0 | 9.7 | 11.0 |
| Aromatics | 48.3 | 58.2 | 53.5 |
| RON | 87 | 88.5 | 88.2 |
| MON | 83.1 | 84.7 | 83.8 |
| Isoamylenes | 0.58 | 0.80 | 0.83 |

TABLE 7

| CATALYST | BASE CATALYST (USY 2.426 nm) | USY 2.426 nm + 20% ZSM-5 | USY 2.426 nm + 20% ITQ-13 |
|---|---|---|---|
| n-Paraffins | 4.0 | 4.8 | 4.9 |
| i-Paraffins | 22.2 | 18.5 | 20.5 |

TABLE 7-continued

| CATALYST | BASE CATALYST (USY 2.426 nm) | USY 2.426 nm + 20% ZSM-5 | USY 2.426 nm + 20% ITQ-13 |
|---|---|---|---|
| Olefins | 8.9 | 6.5 | 8.3 |
| Naphthenes | 11.6 | 9.2 | 9.8 |
| Aromatics | 53.4 | 61.0 | 45.6 |
| RON | 87.4 | 89.2 | 88.2 |
| MON | 83.1 | 84.7 | 83.7 |
| Isoamylenes | 0.45 | 0.60 | 0.81 |

It can be seen from Tables 4 and 5 that ITQ-13 containing catalyst provides much lower yields of propane and butane than the catalysts containing ZSM-5 and FER, so that the propylene/propane ratio and the butene/butane ratio are higher with the ITQ-13 catalyst than for the ZSM-5 and FER catalysts. Moreover, it can be seen from Tables 6 and 7 that addition of the ITQ-13 additive to the USY cracking catalysts gave an increase in the octane number (both RON and MON) of the gasoline produced, although this increase was somewhat less than that obtained with the ZSM-5 additive.

I claim:

1. A catalytic cracking process for selectively producing $C_2$ to $C_4$ olefins, the process comprising contacting, under catalytic cracking conditions, a feedstock containing hydrocarbons having at least 5 carbon atoms with a catalyst composition comprising a synthetic porous crystalline material comprising a framework of tetrahedral atoms bridged by oxygen atoms, the tetrahedral atom framework being defined by a unit cell with atomic coordinates in nanometers shown in Table 1, wherein each coordinate position may vary within ±0.05 nanometer.

2. The process of claim 1, wherein the synthetic porous crystalline material has an X-ray diffraction pattern including d-spacing and relative intensity values substantially as set forth in Table 2.

3. The process of claim 1, wherein the synthetic porous crystalline material has a composition comprising the molar relationship $$X_2O_3:(n)YO_2,$$

wherein n is at least about 5, X is a trivalent element, and Y is a tetravalent element.

4. The process of claim 3, wherein X comprises aluminum and Y comprises silicon.

5. The process of claim 1, wherein the feedstock comprises a naphtha having a boiling range of 25° C. to 225° C.

6. The process of claim 1, wherein the feedstock comprises a naphtha having a boiling range of 25° C. to 125° C.

7. The process of claim 1, wherein the feedstock comprises a hydrocarbon mixture having an initial boiling point of 200° C. and the catalyst composition also comprises a large pore molecular sieve having a pore size greater than 6 Angstrom.

8. The process of claim 7, wherein said hydrocarbon mixture has an initial boiling point above 200° C., a 50% point of at least 260° C. and an end point of at least 315° C.

9. The process of claim 7, wherein said hydrocarbon mixture is selected from the group consisting of vacuum gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, and hydrotreated products of the foregoing.

10. The process of claim 7, wherein the weight ratio of said synthetic porous crystalline material to the large pore molecular sieve is about 0.005 to about 50.

11. The process of claim 7, wherein the weight ratio of said synthetic porous crystalline material to the large pore molecular sieve is about 0.1 to about 1.0.

12. The process of claim 7, wherein said large pore molecular sieve comprises a zeolite Y.

13. The process of claim 7, wherein said large pore molecular sieve is selected from the group consisting of REY, USY or REUSY.

14. The process of claim 1, wherein said catalytic cracking conditions include a temperature of 500 to 650° C.

15. The process of claim 1, wherein said process selectively produces propylene.

16. A catalytic cracking process for selectively producing $C_2$ to $C_4$ olefins, the process comprising contacting, under catalytic cracking conditions, a feedstock containing hydrocarbons having at least 5 carbon atoms with a catalyst composition comprising a synthetic porous crystalline material having a 3-dimensional channel system comprising a first set of generally parallel channels each of which is defined by a 10-membered ring of tetrahedrally coordinated atoms, a second set of generally parallel channels which are also defined by 10-membered rings of tetrahedrally coordinated atoms and which intersect with the channels of the first set, and a third set of generally parallel channels which intersect with the channels of said first and second sets and each of which is defined by a 9-membered ring of tetrahedrally coordinated atoms.

17. The process of claim 16 wherein said first set of 10-ring channels each has cross-sectional dimensions of about 4.8 Angstrom by about 5.5 Angstrom, the second set of 10-ring channels each has cross-sectional dimensions of about 5.0 Angstrom by about 5.7 Angstrom and said third set of 9-ring channels each has cross-sectional dimensions of about 4.0 Angstrom by about 4.9 Angstrom.

18. The process of claim 16, wherein said process selectively produces propylene.

19. The process of claim 16 wherein the catalyst composition also comprises a large pore molecular sieve having a pore size greater than 6 Angstrom.

20. The process of claim 19, wherein said large pore molecular sieve comprises a zeolite Y.

* * * * *